US009144980B2

(12) United States Patent
Watanabe et al.

(10) Patent No.: US 9,144,980 B2
(45) Date of Patent: Sep. 29, 2015

(54) LIQUID EJECTING APPARATUS

(71) Applicant: SEIKO EPSON CORPORATION, Tokyo (JP)

(72) Inventors: Shunsuke Watanabe, Matsumoto (JP); Yuma Fukuzawa, Matsumoto (JP); Katsumi Enomoto, Kanagawa (JP); Hiroaki Okui, Azumino (JP); Yoshinao Miyata, Matsukawa-mura (JP); Satoshi Oguchi, Okaya (JP); Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/421,805

(22) PCT Filed: Aug. 9, 2013

(86) PCT No.: PCT/JP2013/004815

§ 371 (c)(1),
(2) Date: Feb. 13, 2015

(87) PCT Pub. No.: WO2014/027455

PCT Pub. Date: Feb. 20, 2014

(65) Prior Publication Data

US 2015/0202875 A1 Jul. 23, 2015

(30) Foreign Application Priority Data

Aug. 17, 2012 (JP) ..... 2012-180796
Jun. 20, 2013 (JP) ..... 2013-129330
Aug. 6, 2013 (JP) ..... 2013-163039

(51) Int. Cl.
*B41J 2/165* (2006.01)

(52) U.S. Cl.
CPC ..... *B41J 2/16535* (2013.01); *B41J 2/16552* (2013.01); *B41J 2/16538* (2013.01)

(58) Field of Classification Search
CPC . B41J 2/16535; B41J 2/16552; B41J 2/16538
See application file for complete search history.

(56) References Cited

U.S. PATENT DOCUMENTS

2002/0109744 A1* 8/2002 Shindo ..... 347/23
2006/0125875 A1* 6/2006 Ohkuma ..... 347/33
2007/0165070 A1 7/2007 Honma et al.

FOREIGN PATENT DOCUMENTS

JP 2007-216666 8/2007

OTHER PUBLICATIONS

PCT/JP2013/004815, International Search Report dated Oct. 15, 2013. (2 pages).

* cited by examiner

*Primary Examiner* — Lisa M Solomon
(74) *Attorney, Agent, or Firm* — Workman Nydegger

(57) ABSTRACT

A wiper member 12 that wipes an anchoring plate exposed-surface 17*b* located on the opposite side of the head unit 16 of the anchoring plate 17 and the nozzle surface 22*a*. When an angle of contact between the nozzle surface 22*a* and the liquid is taken as θn, an angle of contact between the anchoring plate exposed-surface 17*b* and the liquid is taken as θs, and an angle of contact between the wiper member 12 and the liquid is taken as θw, the relationship θn>θs>θw>90° is fulfilled.

4 Claims, 6 Drawing Sheets

LIQUID EJECTING APPARATUS

TECHNICAL FIELD

The present invention relates to liquid ejecting apparatuses provided with liquid ejecting heads such as ink jet recording heads, and particularly relates to a liquid ejecting apparatus provided with a wiper member that wipes a nozzle surface in which nozzles are formed.

BACKGROUND ART

A liquid ejecting apparatus is an apparatus that includes a liquid ejecting head, and that ejects various types of liquid from this liquid ejecting head. Image recording apparatuses such as ink jet printers, ink jet plotters, and so on can be given as examples of such a liquid ejecting apparatus, but recently, such technology is also being applied in various types of manufacturing apparatuses that exploit an advantage in which extremely small amounts of liquid can be caused to land in predetermined positions in a precise manner. For example, such technology is being applied in display manufacturing apparatuses that manufacture color filters for liquid-crystal displays and so on, electrode formation apparatuses that form electrodes for organic EL (electroluminescence) displays, FEDs (field emission displays), and so on, chip manufacturing apparatuses that manufacture biochips (biochemical devices), and the like. While a recording head in an image recording apparatus ejects ink in liquid form, a coloring material ejecting head in a display manufacturing apparatus ejects R (red), G (green), and B (blue) coloring material solutions. Likewise, an electrode material ejecting head in an electrode formation apparatus ejects an electrode material in liquid form, and a bioorganic matter ejecting head in a chip manufacturing apparatus ejects a bioorganic matter solution.

In some such liquid ejecting heads, a plurality of liquid ejecting head units, which eject a liquid from nozzles formed in a nozzle surface by driving a piezoelectric element (a type of pressure generation unit) and producing pressure fluctuations in a liquid within a pressure chamber, are anchored to an anchoring plate (for example, see PTL 1). An opening region is provided in the anchoring plate, and the configuration is such that the nozzles of each liquid ejecting head unit are exposed through the opening region. Meanwhile, generally, a wiper member that wipes the bottom surface of the liquid ejecting head (that is, the bottom surface of the anchoring plate, the nozzle surface, or the like) is provided in the liquid ejecting apparatus. The wiper member is configured to be capable of moving relative to the liquid ejecting head.

CITATION LIST

Patent Literature

PTL 1: Japanese Unexamined Patent Application Publication No. 2007-216666

SUMMARY OF INVENTION

Technical Problem

With a liquid ejecting head configured in this manner, a step is formed at the edges of the opening region in the anchoring plate, between the exposed surface of the anchoring plate (the surface that the wiper member makes contact with during wiping) and the nozzle surface; accordingly, when liquid that adheres to the bottom surface of the liquid ejecting head is wiped using the wiper member, there is a risk that liquid will remain on the nozzle surface. Specifically, when the bottom surface of the liquid ejecting head is wiped from one side thereof toward the other side thereof, the wiper member moves along the surface of the anchoring plate while making tight contact therewith, with the liquid that has been wiped from the anchoring plate being held on a front surface of the wiper member (that is, the surface of the wiper member located on the side in which the wiper member advances). Then, when the wiper member reaches the stepped area at the opening region, some of the liquid held on the front surface of the wiper member accumulates in the corner of the stepped area, and this accumulated liquid then adheres to a rear surface of the wiper member (that is, the surface of the wiper member located on the opposite side to the side in which the wiper member advances) immediately after the wiper member has passed the stepped area. When the wiper member then moves in the direction of the nozzle surface, the liquid that adheres to the wiper member is spread across the nozzle surface as the wiper member advances. The liquid that has been spread in this manner may be pulled out and cut from the wiper member and remain on the nozzle surface.

When the liquid remains on the nozzle surface in this manner, there is a risk that the remaining liquid will drip down onto recording paper (a type of landing target) and adhere to the recording paper, will be transferred onto the recording paper due to the recording paper making contact with the liquid ejecting head, and so on, resulting in the recording paper being soiled. In addition, if the liquid enters into the nozzles, there is a risk that ejection malfunctions will occur. Further still, in the case where a configuration in which the nozzle surface is capped by a capping member is employed, there is a risk that liquid remaining at areas where the capping member makes contact will dry out and build up, resulting in a gap forming between the nozzle surface and the capping member.

It is an advantage of some aspects of the invention to provide a liquid ejecting apparatus capable of suppressing ink from remaining on a nozzle surface.

Solution to Problem

The present invention is proposed to achieve the above-described object, and there is provided a liquid ejecting apparatus including a liquid ejecting head unit capable of ejecting a liquid from a nozzle provided in a nozzle surface of a nozzle formation member, an anchoring plate that is anchored to the liquid ejecting head unit and that is provided with an opening region that exposes the nozzle surface, and a wiper member that wipes the nozzle surface and an anchoring plate exposed-surface located on the opposite side of the anchoring plate to the liquid ejecting head unit; and when an angle of contact between the nozzle surface and the liquid is taken as $\theta n$, an angle of contact between the anchoring plate exposed-surface and the liquid is taken as $\theta s$, and an angle of contact between the wiper member and the liquid is taken as $\theta w$, the relationship $\theta n > \theta s > \theta w > 90°$ is fulfilled.

According to the invention, an angle of contact between the nozzle surface and the liquid is greater than 90°, that is, the nozzle surface is liquid-repellent, and thus liquid can be suppressed from remaining on the nozzle surface. The angle of contact between the nozzle surface and the liquid is greater than the angle of contact between the anchoring plate exposed-surface of the anchoring plate and the liquid, the wiper member and the liquid, and so on; accordingly, it is easier for the liquid to move toward (or adhere to) the anchoring plate, the wiper member, or the like than the nozzle surface, which makes it possible to further suppress the liquid from remaining on the nozzle surface. Further, the angle of contact between the wiper member and the liquid is greater than 90°, which makes it possible to prevent the liquid from adhering to the rear surface of the wiper member (the surface of the wiper member located on the opposite side to the side in which the wiper member advances); this in turn makes it possible to further suppress the liquid from remaining on the nozzle surface.

In the stated configuration, it is desirable to employ a configuration in which a gap is provided between an edge of the opening region of the anchoring plate and the nozzle formation member, and the gap is filled with a filler.

According to this configuration, skew in the dimensions of the anchoring plate, the nozzle formation member, or the like can be permitted by the gap. Furthermore, because the gap is filled with the filler, the liquid can be prevented from remaining in the gap, and the liquid that does remain can be suppressed from adhering to the nozzle surface.

Furthermore, in the stated configuration, it is desirable, when an angle of contact between the filler and the liquid is taken as θf, for the relationship θn>θf>θs to be fulfilled.

According to this configuration, it is easier for liquid on the nozzle surface to move toward the anchoring plate via the filler, and the liquid can be further suppressed from remaining on the nozzle surface.

Furthermore, in the stated configurations, it is desirable for the wiper member to be formed of an elastic member.

According to this configuration, the tightness of contact between the nozzle surface and the wiper member can be improved. This makes it possible to further suppress the liquid from remaining on the nozzle surface.

DESCRIPTION OF EMBODIMENTS

Hereinafter, embodiments of the invention will be described with reference to the appended drawings. Although various limitations are made in the embodiments described hereinafter in order to illustrate a specific preferred example of the invention, it should be noted that the scope of the invention is not intended to be limited to these embodiments unless such limitations are explicitly mentioned hereinafter. The following describes an ink jet printer (called simply a "printer") 1 provided with an ink jet recording head (called simply a "recording head") 3 as an example of a liquid ejecting apparatus according to the invention.

Figure 1:
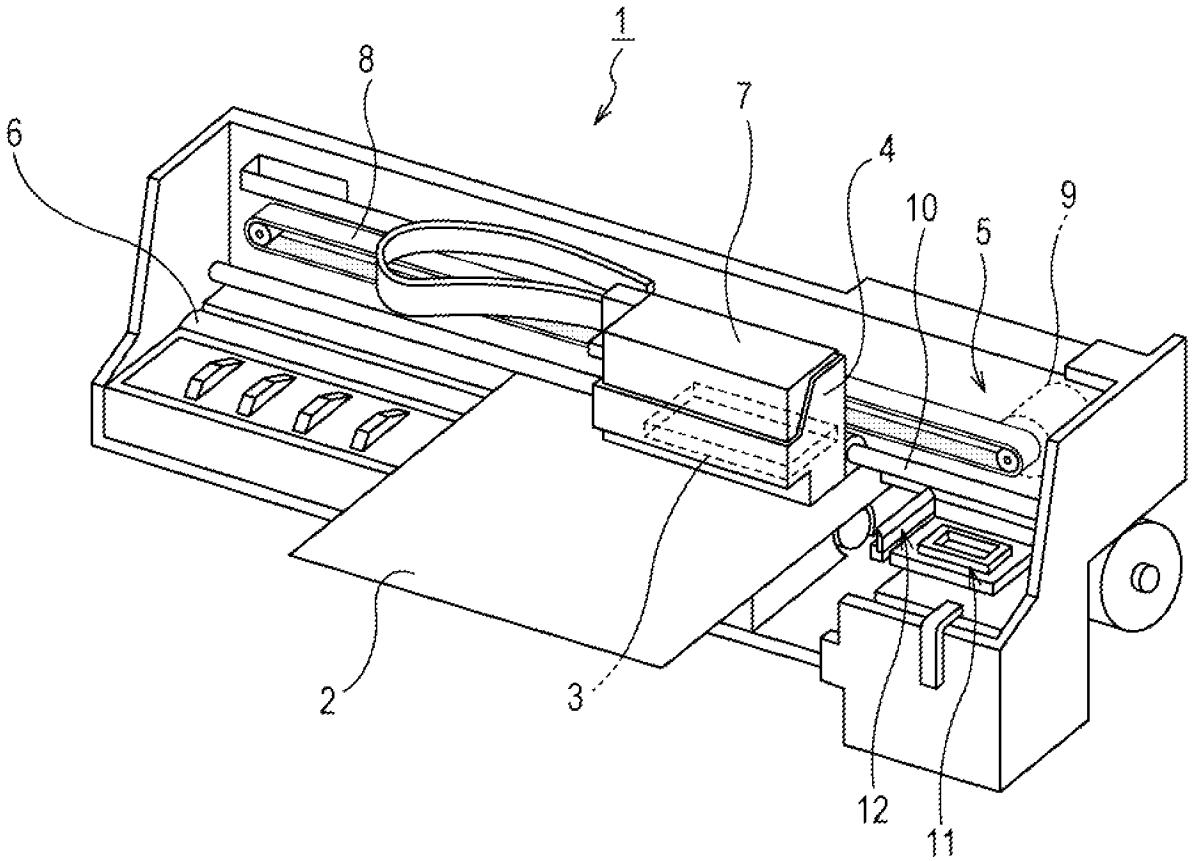
FIG. 1 is a perspective view illustrating the configuration of a printer.

The configuration of the printer 1 will be described with reference to FIG. 1. The printer 1 is an apparatus that records images and the like by ejecting ink in liquid form onto the surface of a recording medium 2 (a type of landing target) such as recording paper or the like. The printer 1 includes the recording head 3 that ejects ink, a carriage 4 to which the recording head 3 is attached, a carriage movement mechanism 5 that moves the carriage 4 in a main scanning direction, a platen roller 6 that moves the recording medium 2 in a sub scanning direction, and so on. Here, the aforementioned ink is a type of liquid according to the invention, and is held in an ink cartridge 7 serving as a liquid supply source. The ink cartridge 7 is mounted in the recording head 3 in a removable state. Note that it is also possible to employ a configuration in which the ink cartridge 7 is disposed in the main body of the printer 1 and the ink is supplied to the recording head 3 from the ink cartridge 7 via an ink supply tube.

The stated carriage movement mechanism 5 includes a timing belt 8. The timing belt 8 is driven by a pulse motor 9 such as a DC motor or the like. Accordingly, when the pulse motor 9 operates, the carriage 4 moves back and forth in the main scanning direction (corresponding to a width direction of the recording medium 2) while being guided by a guide rod 10 that is provided in the printer 1.

A home position, which serves as a base point for the scanning performed by the carriage 4, is set within the movement range of the carriage 4 in an end region that is outside of a recording region. A capping member 11 that seals a nozzle surface 22*a* (see FIG. 4) of the recording head 3 and a wiper member 12 for wiping an anchoring plate exposed-surface 17*b* (mentioned later) and the nozzle surface 22*a* are provided at the home position in this embodiment. A material whose angle of contact with the ink is greater than 90° (is ink-repellent) and whose angle of contact with the ink is smaller than that of the anchoring plate exposed-surface 17*b* and the nozzle surface 22*a* (mentioned later) is employed as the material of the wiper member 12 in this embodiment. In addition, the wiper member 12 is formed of an elastic member such as a resin or the like. This makes it possible to improve the tightness of contact between the nozzle surface 22*a* and the wiper member 12. Wiping performed by the wiper member 12 will be described later.

Figure 2:
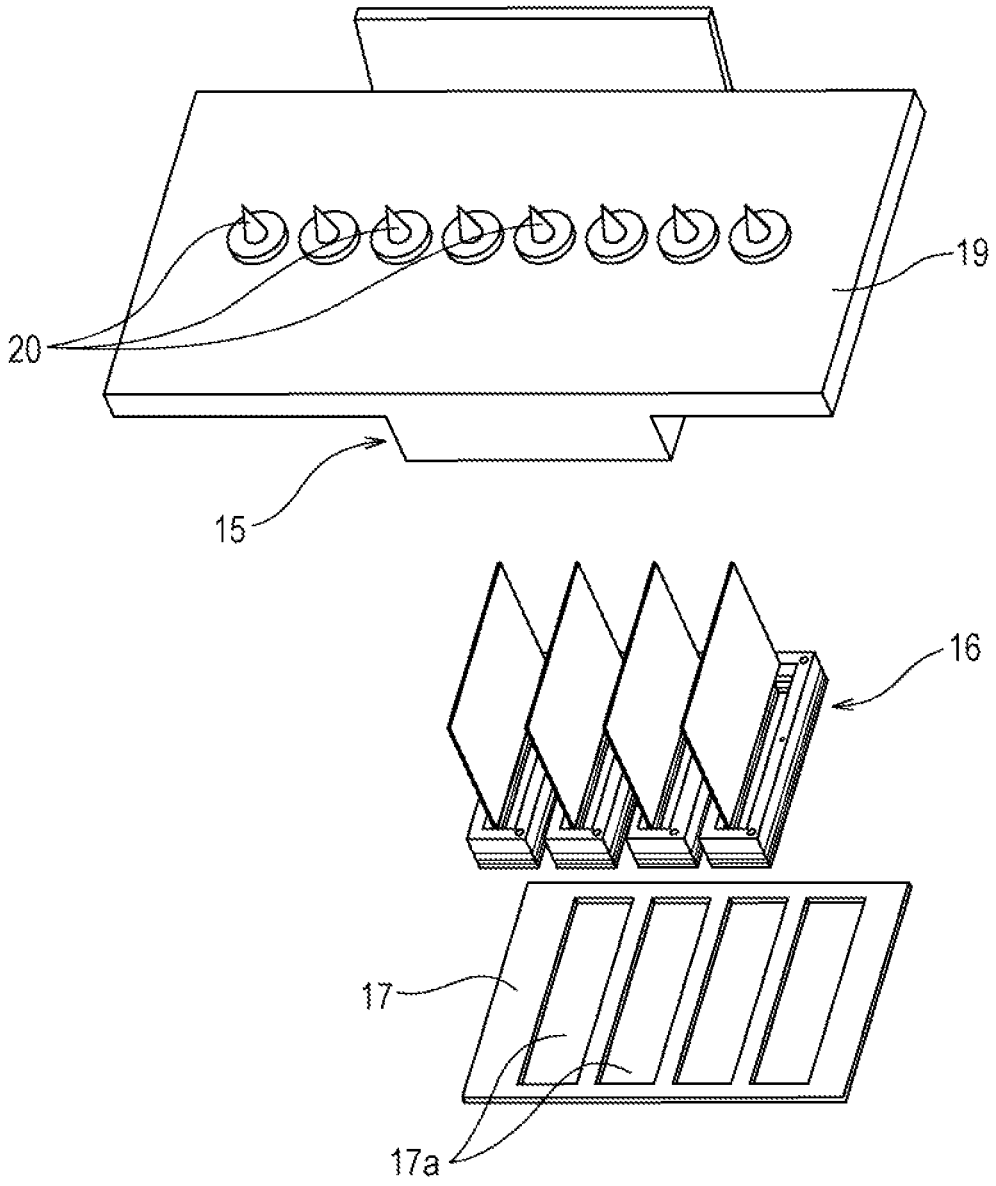
FIG. 2 is an exploded perspective view of a recording head, viewed at an angle from above.
Figure 3:
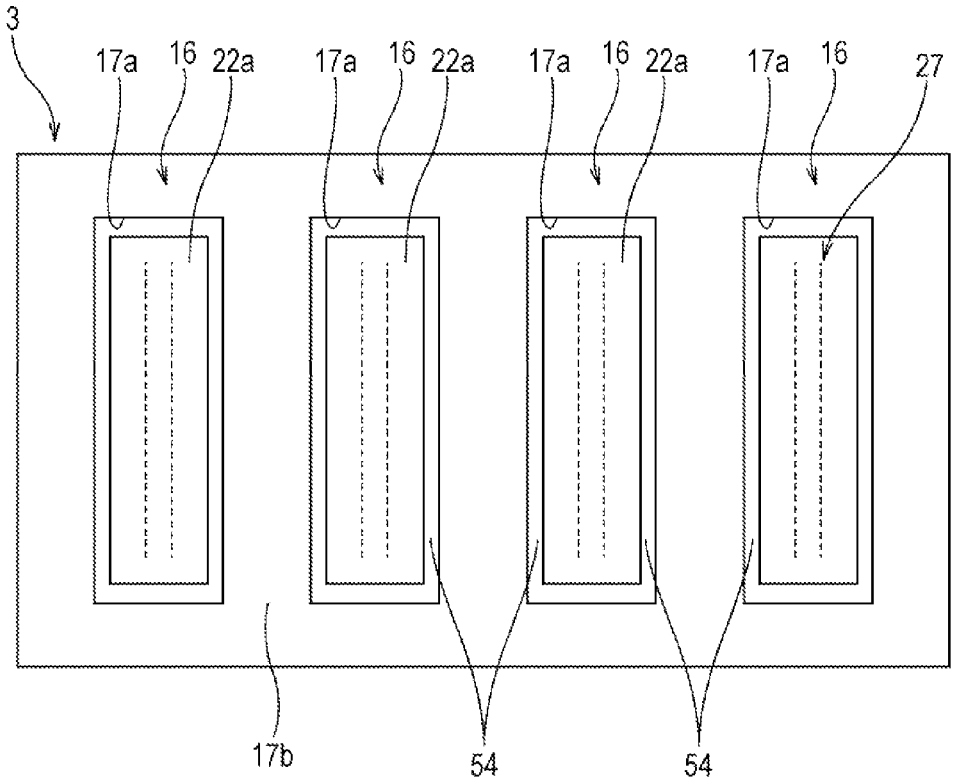
FIG. 3 is a bottom view of a recording head.
Figure 4:
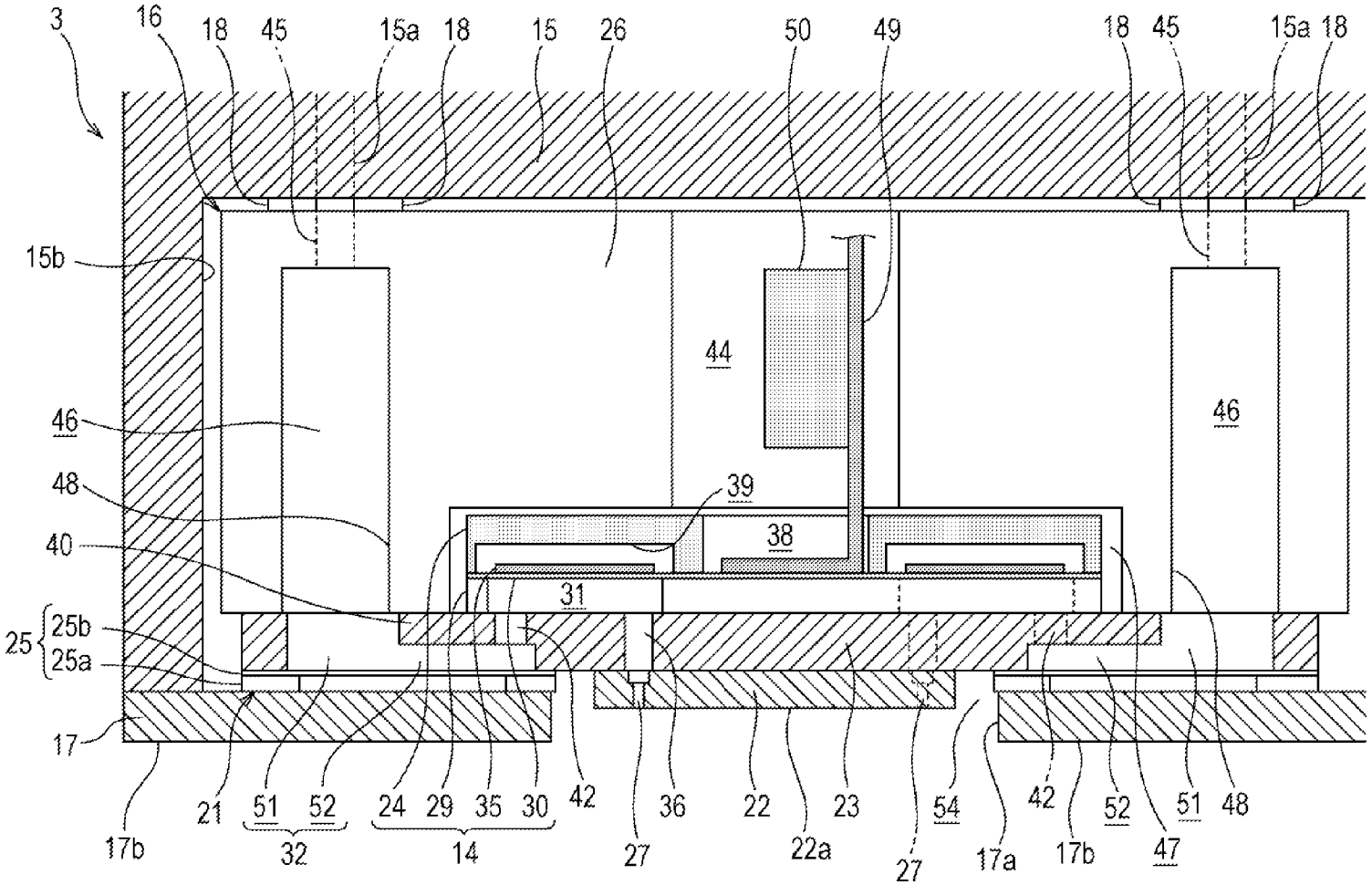
FIG. 4 is a cross-sectional view of a head unit.

FIG. 2 is an exploded perspective view illustrating the overall configuration of the stated recording head 3. FIG. 3 is a bottom view of the recording head 3. FIG. 4 is a cross-sectional view illustrating the primary components of the recording head 3 in an enlarged manner. The recording head 3 according to this embodiment includes a case 15, a plurality of head units 16 (a type of liquid ejecting head unit according to the invention), and a unit anchoring plate (a type of anchoring plate according to the invention).

The case 15 is a box-shaped member, made of a synthetic resin, that includes the plurality of head units 16, ink supply channels 15*a* (see FIG. 4) that supply ink to the head units 16, and so on, and a pin holder 19 is formed on a top surface side thereof. The pin holder 19 is a member in which ink conducting pins 20 are erected, and in this embodiment, a total of eight ink conducting pins 20, corresponding to respective colors of ink in the ink cartridge 7, are disposed horizontally in the pin holder 19. The ink conducting pins 20, meanwhile, are hollow, pin-shaped members that are inserted into the ink cartridge 7, and conduct the ink held in the ink cartridge 7 toward the head unit 16 through the ink supply channels 15*a* within the case 15 from conducting holes (not shown) that are provided in leading end areas of the ink conducting pins 20.

Meanwhile, a unit containment cavity 15*b* (see FIG. 4) is provided on the base surface side of the case 15 so as to be recessed in the opposite direction thereto (that is, toward the pin holder 19). Four of the head units 16 are arranged horizontally in the main scanning direction and held within the unit containment cavity 15*b*. The unit anchoring plate 17 is made of a metal and is provided with four opening regions 17*a* that correspond to the respective head units 16, and the head units 16 are positioned and anchored to the unit anchoring plate 17 so that nozzle plates 22 (nozzle surfaces 22*a*)

thereof are exposed through the opening regions 17*a*. Peripheral edge areas of the upper surface of the unit anchoring plate 17 (that is, the surface on the side where the head units 16 are anchored) are anchored to the edges of the unit containment cavity 15*b* on the bottom surface of the case 15 (that is, the edges that are outside relative to the opening regions 17*a*). As a result, the head units 16 are positioned and anchored to the case 15 while being contained within the unit containment cavity 15*b*. An ink-repelling process (for example, providing a water-repellent film or the like) is carried out on the anchoring plate exposed-surface 17*b*, which is on the side of the unit anchoring plate 17 that is opposite to the head units 16. This will be described later.

In this embodiment, the depth of the unit containment cavity 15*b* is set to be slightly greater than the design value of the heights of the head units 16 (see FIG. 4) so that the head units 16 can be contained within the unit containment cavity 15*b* even if the heights of the head units 16 vary. Accordingly, when the head units 16 are contained in the unit containment cavity 15*b*, a small gap is formed between the upper surfaces of the head units 16 and a ceiling surface (the surface that faces the top surface of the head units 16) of the unit containment cavity 15*b*. Filling an area of this gap that surrounds a communication section between ink conducting openings 45 (mentioned later) and the ink supply channels 15*a* with an adhesive 18 secures the top surfaces of the head units 16 to the ceiling surface of the unit containment cavity 15*b*. Note that gaskets may be provided at the edges of openings of the ink conducting openings 45 and edges of openings of the ink supply channels 15*a* in the communication section, and the ink conducting openings 45 and ink supply channels 15*a* may communicate by the surfaces that face the gaskets making contact with those gaskets. In this case, the areas surrounding the gaskets are filled with the adhesive 18.

Next, the internal configuration of the head unit 16 will be described using FIG. 4. Note that for the sake of simplicity, the descriptions assume that the respective members that configure each head unit 16 are layered from top to bottom. Each head unit 16 according to this embodiment includes a pressure generation unit 14 and a flow channel unit 21, and is configured by attaching these members to a unit case 26 (a type of case member) in a stacked state. The flow channel unit 21 includes a communication plate 23 (a type of common liquid chamber formation member), the nozzle plate 22 (a type of nozzle formation member according to the invention), and compliance plates 25. In addition, the pressure generation unit 14 includes a pressure chamber formation plate 29 (a type of pressure chamber formation member) in which pressure chambers 31 are formed, an elastic film 30, piezoelectric elements 35 (a type of pressure generation unit), and a protective plate 24; these members are stacked and form a single unit.

The unit case 26 is a box-shaped member, made of a synthetic resin, and the communication plate 23, to which the nozzle plate 22, the compliance plates 25, and the pressure generation unit 14 are joined, is anchored to a bottom surface side of the unit case 26. A through-cavity 44 having a long, rectangular opening that follows a nozzle row direction when viewed from above the unit case 26 is formed in a central area thereof, and is formed so as to pass through the unit case 26 in the height direction thereof. This through-cavity 44 forms a cavity that communicates with a wiring cavity 38 of the pressure generation unit 14 and contains one end area of a flexible cable 49 and a driving IC 50 (both of which will be described later). Meanwhile, a containment cavity 47 is formed in a lower surface of the unit case 26 so as to be recessed in a rectangular parallelepiped from the bottom surface of the unit case 26 to partway along the height direction of the unit case 26. The depth of this containment cavity 47 is set to be slightly greater than the thickness (height) of the pressure generation unit 14. Dimensions of the containment cavity 47 in a first direction (a row direction (arrangement direction) of nozzles 27) and a second direction (the direction orthogonal to the first direction in the nozzle surface 22*a*) are set to be slightly greater than the respective corresponding dimensions of the pressure generation unit 14. When the flow channel unit 21 is positioned and joined to the bottom surface of the unit case 26, the pressure generation unit 14 that is stacked upon the communication plate 23 is contained in the containment cavity 47. A bottom end of the through-cavity 44 is open to the ceiling surface of the containment cavity 47.

Ink conducting cavities 46 and the ink conducting channels 45 are formed in the unit case 26. The ink conducting channel 45 is a narrow channel whose cross-sectional area is set to be smaller than that of the ink conducting cavity 46; an upper end of the ink conducting channel 45 is open to the top surface of the unit case 26, whereas a lower end of the ink conducting channel 45 is open to a central area of the corresponding ink conducting cavity 46 in the lengthwise direction thereof (that is, the first direction). Ink from the ink cartridge 7 passes through the ink supply channels 15*a* and the ink conducting channels 45, flows into the ink conducting cavities 46, and is conducted into corresponding common liquid chambers 32 in the communication plate 23 from the ink conducting cavities 46.

The ink conducting cavities 46 are formed in positions of the unit case 26 that are toward the outside in the second direction, with partition walls 48 provided between respective ink conducting cavities 46 and the containment cavity 47. More specifically, a total of two ink conducting cavities 46 are formed, one on either side of the containment cavity 47, so as to correspond to the common liquid chambers 32 in the communication plate 23. When the communication plate 23 is joined to the unit case 26, the respective ink conducting cavities 46 communicate with corresponding common liquid chambers 32. The partition walls 48 that separate the containment cavity 47 and the ink conducting cavities 46 are formed in positions that correspond to a thin section 40 of the communication plate 23. When the unit case 26 and the communication plate 23 are joined to each other, bottom surfaces of the partition walls 48 and a top surface of the thin section 40 are joined to each other. By employing such a configuration, the containment cavity 47 is a space that is independent of flow channels such as the ink conducting cavities 46. For this reason, the pressure generation unit 14, particularly, the end surface of the pressure chamber formation plate 29 and the protective plate 24 are prevented from being in contact with ink, and thus it is possible to suppress corrosion of the end surface of the pressure chamber formation plate 29 and the protective plate 24 by ink. Therefore, there is no need to cover the end surface of the pressure chamber formation plate 29 and the protective plate 24 by a liquid-resistant protecting film (ink-resistance) and it is possible to simplify the manufacturing process. In this connection, the pressure chamber formation plate 29 and the protective plate 24 can be manufactured by, for example, integrally forming a plurality of wafers in a substrate and then dividing the substrate into a chip size, but for high efficiency, forming of the protecting film is preferably performed before dividing the substrate into a chip size. However, in a case of a passage structure in which the divided substrates or the end surface thereof is in contact with ink, it is necessary to form the protecting film on the divided substrates or the end surface thereof after dividing into a chip size, which results in an increase in the manufacturing process.

Although past configurations have provided a space corresponding to a common liquid chamber in pressure generation units as well, the configuration of this embodiment miniaturizes the pressure generation unit 14 without providing a space corresponding to a common liquid chamber in the pressure generation unit 14. As described above, by miniaturizing the pressure generation unit 14, a degree of freedom of the structure of the head unit 16 becomes high, which results in a contribution of miniaturization of the head unit 16. To make the containment cavity 47 an independent space from the flow channels while miniaturizing the pressure generation unit 14, the configuration is such that the partition walls 48 are provided between the ink conducting cavities 46 and the containment cavity 47 and the bottom surfaces of the partition walls 48 and the top surface of the thin section 40 in the communication plate 23 are joined to each other. As a result, in the head unit 16 according to the invention, the thin section 40 is provided on a top surface side of second liquid chambers 52 in the common liquid chambers 32. Meanwhile, the thin section 40 is, specifically, a portion extending toward the first liquid chamber 51 from the individual communication openings 42 described later, and the second liquid chamber 52 which is a non-passage section is formed on the side of the compliance plates 25 of the thin section 40. In addition, as described above, the unit case 26 is joined to one surface side of the communication plate 23 in the present embodiment.

The pressure chamber formation plate 29, of which the pressure generation unit 14 is partially configured, is created from a silicon single-crystal substrate (a type of crystalline substrate; also called simply a "silicon substrate"). A plurality of the pressure chambers 31 are formed in the pressure chamber formation plate 29, corresponding to the respective nozzles 27 in the nozzle plate 22, by performing an anisotropic etching process on the silicon substrate. By forming the pressure chambers 31 through anisotropic etching on the silicon substrate, it is possible to ensure a high level of precision in the dimensions and shapes thereof. Further, as described above, since the pressure generation unit 14 is miniaturized without having a common liquid chamber, it is possible to increase the number of pressure chamber formation plates which can be manufactured by one sheet of the silicon wafer, thereby contributing to cost reduction. As will be described later, two rows of the nozzles 27 are formed in the nozzle plate 22 in this embodiment, and therefore two rows of the pressure chambers 31 are formed in the pressure chamber formation plate 29 corresponding to the respective nozzle rows. The pressure chambers 31 are cavities that are longer in the direction (the second direction) orthogonal to the direction in which the nozzles 27 are arranged (the first direction). When the pressure chamber formation plate 29 (the pressure generation unit 14) is positioned relative to the communication plate 23 (described later) and joined thereto, one end of each pressure chamber 31 in the second direction thereof communicates with a corresponding nozzle 27 via a nozzle communication channel 36 in the communication plate 23, which will be mentioned later. The other end of the pressure chamber 31 in the second direction thereof communicates with a corresponding common liquid chamber 32 via an individual communication opening 42 in the communication plate 23. That is, the pressure chamber formation plate 29 is joined to the one surface which is the same surface to which the unit case 26 of the communication plate 23 is joined.

Here, the pressure generation unit 14 is configured to have a different material from the unit case 26 and the pressure chamber formation plate 29 which is a component of the pressure generation unit 14 and the unit case 26 are respectively joined to the horizontal surface. That is, the pressure chamber formation plate 29 and the unit case 26 are respectively joined to the surface extending toward the horizontal direction perpendicular to the orthogonal direction which is a stacking direction with the communication plate 23. As described above, by joining the pressure chamber formation plate 29 and the unit case 26 to the horizontal surface, it is possible to suppress leakage of ink (liquid) compared to a case of joining to the vertical surface and a case where the horizontal surface and the vertical surface are mixed as the joint surface. That is, generally, in a case of the vertical surface (the surface in the vertical direction), the leakage of ink is easily generated since the joining strength is weak compared to a case of the horizontal surface and when the horizontal surface and the vertical surface are mixed as the joint surface, a variation is generated in a gap due to the dimensional tolerance. Therefore, a sealed state by the adhesive, that is, a variation in the joining strength is easily generated due to a variation in the thickness of the adhesive. Accordingly, by joining the pressure generation unit 14 and the unit case 26 to the horizontal surface, it is possible to enhance the joining strength and to suppress the leakage of ink.

Further, the pressure chamber formation plate 29 and the unit case 26 are joined to the thin section 40, and the pressure chambers 31 included in the pressure chamber formation plate 29 and the ink conducting cavity 46 included in the unit case 26 are communicated with each other through the individual communication openings 42 and the first liquid chamber 51 (passage section) extending toward the vertical direction therefrom. In other words, the pressure chamber formation plate 29 is continuously joined to one surface (horizontal surface) of the communication plate 23 over the periphery of the openings of the pressure chambers 31 without providing a flow channel of ink (liquid) in the joint surface of the pressure chamber formation plate 29 and the thin section 40, additionally, the unit case 26 is continuously joined to one surface (horizontal surface) of the communication plate 23 over the periphery of the openings of the ink conducting cavity 46 without providing a flow channel of ink (liquid) in the joint surface of the unit case 26 and the thin section 40. Accordingly, it is possible to make the area, where the pressure chamber formation plate 29 and the unit case 26 are joined to the communication plate 23, larger and thus to suppress the leakage of ink. Meanwhile, not providing the flow channel of ink (liquid) in the joint surface of the pressure chamber formation plate 29 and the thin section 40 means the area where the pressure chamber formation plate 29 and the elastic film 30 are joined to each other can be made larger, thereby having an effect on the suppression of the leakage of ink.

Further, when the horizontal surface to which the unit case 26 is joined is assumed to be the communication plate 23 formed of the same members, since there is no case of joining over the differences in level between different members and thus a variation is suppressed, it is possible to suppress the leakage of ink. Similarly, when the horizontal surface to which the pressure chamber formation plate 29 is joined is assumed to be the communication plate 23 formed of the same members, since there is no case of joining over the differences in level between different members and thus a variation is suppressed, it is possible to suppress the leakage of ink.

Note that in the present embodiment, the pressure chambers 31 is communicated with the common liquid chambers 32 on the opposite side to the surface to which the protective plate 24 of the pressure chamber formation plate 29 is joined. Since there is no need to provide a communication opening communicating the pressure chambers 31 and the common liquid chambers 32 in addition to the piezoelectric elements 35 on the surface to which the protective plate 24 of the pressure chamber formation plate 29 is joined, it is possible to suppress the size of the relief cavity 39 and to reduce the area of the pressure chamber formation plate 29 (second direction).

The elastic film 30 is formed on the top surface of the pressure chamber formation plate 29 (the surface on the opposite side to the surface that is joined to the communication plate 23) so as to seal upper openings of the pressure chambers 31. The elastic film 30 is configured of, for example, approximately 1 μm-thick silicon dioxide. An insulating film (not shown) is formed upon the elastic film 30. The insulating film is configured of, for example, zirconium oxide. The piezoelectric elements 35 are formed in positions on the elastic film 30 and the insulating film that correspond to the respective pressure chambers 31. The piezoelectric elements 35 are so-called flexurally-vibrating mode piezoelectric elements. The piezoelectric elements 35 are configured by layering a metallic lower electrode film, a piezoelectric material layer configured of lead zirconate titanate (PZT), and a metallic upper electrode film (all of which are not shown) in that order upon the elastic film 30 and the insulating film and then patterning these layers on each of the pressure chambers 31. One of the upper electrode film and the lower electrode film is employed as a common electrode, whereas the other is employed as individual electrodes. The elastic film 30, the insulating film, and the lower electrode film function as a vibrating plate when the piezoelectric elements 35 are driven.

Electrode wiring portions (not shown) extend above the insulating film from the respective individual electrodes of the piezoelectric elements 35 (that is, from the upper electrode film), and a terminal on one end of the flexible cable 49 is connected to areas of the electrode wiring portions that correspond to electrode terminals. The flexible cable 49 is configured by, for example, forming a conductive pattern using copper foil or the like on a base film such as polyimide and wrapping the conductive pattern with a resistant layer. The driving IC 50 that drives the piezoelectric elements 35 is mounted on the surface of the flexible cable 49. The piezoelectric elements 35 flex and deform as a result of driving signals (driving voltages) being applied between the upper electrode film and the lower electrode film via the driving IC 50.

The protective plate 24 is disposed on the top surface of the communication plate 23 on which the stated piezoelectric elements 35 are formed. The protective plate 24 is a hollow, box-shaped member whose lower surface side is open, and is created from, for example, glass, a ceramic material, a silicon single-crystal substrate, a metal, a synthetic resin, or the like. A relief cavity 39 having a size that ensures that the driving of the piezoelectric elements 35 is not obstructed is formed within the protective plate 24, and a region that opposes the piezoelectric elements 35. Furthermore, the wiring cavity 38 is formed in the protective plate 24 between adjacent piezoelectric element rows, and is formed passing through the protective plate 24 in the thickness direction thereof. The electrode terminals of the piezoelectric elements 35 and one end area of the flexible cable 49 are disposed within the wiring cavity 38.

The communication plate 23 that serves as a base portion of the flow channel unit 21 is a plate member created from a silicon substrate, and the common liquid chambers 32 are formed through anisotropic etching. The common liquid chambers 32 are cavities that are longer in the direction in which the pressure chambers 31 are arranged (that is, the first direction). Each common liquid chamber 32 is configured of a first liquid chamber 51 that passes through the communication plate 23 in the thickness direction thereof (a passage section) and the second liquid chamber 52 formed so as to extend from the lower surface side to the upper surface side of the communication plate 23 until partway along the thickness direction of the communication plate 23, leaving the thin section 40 on the upper surface side thereof (a non-passage section). That is, the thin section 40 means a portion extending toward the side of the first liquid chamber 51 from the side of the individual communication openings 42.

An opening of the first liquid chamber 51 on the upper surface side of the communication plate 23 functions as an entrance opening section through which ink is conducted. That is, ink from the ink conducting channel 45 and the ink conducting cavity 46 formed in the unit case 26 enters into the first liquid chamber 51 via the entrance opening section. Both end areas of the first liquid chamber 51 in the lengthwise direction thereof, or in other words, in the first direction, are formed so as to gradually narrow toward those respective end areas. To be more specific, at both end areas of the first liquid chamber 51, at least one of the surfaces of walls that face each other so as to define the first liquid chamber 51 is sloped so as to approach the other wall surface as the first liquid chamber 51 progresses toward the end area in the first direction. By setting the shape of the opening of both end areas of the first liquid chamber 51 to be narrower at the ends thereof, it is possible to suppress a drop in the flow velocity of the ink at both end areas of the first liquid chamber 51. Accordingly, the supply pressure of the ink supplied to the pressure chambers 31 through the individual communication openings 42 can be made uniform.

The second liquid chamber 52 is a recess formed adjacent to the first liquid chamber 51. The aforementioned thin section 40 configures a ceiling surface of the second liquid chamber 52. The second liquid chamber 52 is formed so that one end area thereof in the second direction (that is, the end area that is further from the nozzles 27) communicates with the first liquid chamber 51 and the other end area in the second direction is in a position corresponding to an area below the pressure chamber 31. A plurality of the individual communication openings 42 that pass through the thin section 40 are formed along the first direction in areas corresponding to the respective pressure chambers 31 in the pressure chamber formation plate 29, in the other end area of the second liquid chamber 52, or in other words, an edge area on the opposite side to the first liquid chamber 51. Lower ends of the individual communication openings 42 communicate with the second liquid chamber 52, whereas upper ends of the individual communication openings 42 communicate with the pressure chambers 31 in the pressure chamber formation plate 29.

The nozzle plate 22 is a plate member in which a plurality of the nozzles 27 are provided in a row at a pitch corresponding to a dot formation density. In this embodiment, the nozzle rows (a type of nozzle group) are formed by arranging 360 of the nozzles 27 in a row at a pitch corresponding to 360 dpi. A surface of the nozzle plate 22 on the lower side thereof (the opposite side to the communication plate 23) corresponds to the nozzle surface 22*a*, and is set to have a greater angle of contact with the ink than the anchoring plate exposed-surface 17*b* and the wiper member 12 by performing an ink-repelling process thereon (for example, providing a water-repellent film or the like thereon). In addition, in this embodiment, two nozzle rows are formed in the nozzle plate 22. Furthermore, the nozzle plate 22 according to this embodiment is created from a silicon substrate that is thinner than the unit anchoring plate 17. Note that the thickness of the nozzle plate 22 is determined based on the specifications of the nozzles 27, and therefore cannot be made thick in the same manner as the unit anchoring plate 17. Accordingly, the nozzle surfaces 22*a* are located higher (that is, closer to the communication plate 23) than the anchoring plate exposed-surface 17*b* of the unit anchoring plate 17. The cylindrical nozzles 27 are formed by dry-etching the substrate. Forming the nozzles 27 through dry etching in this manner makes it possible to form the nozzles 27 at a higher level of precision than, for example, a configuration in which nozzles are formed by performing a deformation process on a metal plate such as a stainless steel plate. This improves the landing precision of the ink ejected from the nozzles 27.

With respect to dimensions of the nozzle plate 22, a dimension in at least the direction orthogonal to the nozzle rows (that is, the second direction) is set to be smaller than a dimension of the pressure generation unit 14 in the second direction, a dimension of the communication plate 23 in the second direction, and a dimension of the unit case 26 in the second direction. Specifically, the dimension is set to be as small as possible within a range in which a fluid-tight state can be ensured between the nozzle communication channels 36 and the nozzles 27, which will be mentioned later (that is, to the extent that a joint area enabling the nozzle communication channels 36 and the nozzles 27 to communicate in a fluid-tight state can be ensured). Miniaturizing the nozzle plate 22 to the greatest extent possible in such a manner makes it possible to contribute to a reduction in costs. When the nozzle communication channels 36 and the nozzles 27 are positioned in a communicating state and the communication plate 23 and the nozzle plate 22 are joined to each other, the common liquid chambers 32 are exposed without being covered by the nozzle plate 22. Meanwhile, when the head unit 16 is positioned and anchored to the unit anchoring plate 17, the nozzle plate 22 (nozzle surfaces 22*a*) is exposed from the opening regions 17*a* of the unit anchoring plate 17.

In addition, in the present embodiment, the communication plate 23 is configured by a single member (a sheet of substrate). In other words, the communication plate 23 is provided with a return flow channel, that is, since the flow channel in which the communication plate 23 and the nozzle plate 22 are overlapped with each other is not provided when a projection is performed in a stacking direction thereof, the communication plate 23 can be formed by a single member (a sheet of substrate). Further, since it is difficult to form the return flow channel on the communication plate 23 with a single member (a sheet of substrate) through a molding or machining process, it is necessary to stack a plurality of members (substrates). When the communication plate 23 is formed by stacking the plurality of members, there is a need to provide a space for adhering between the respective members and thereby the communication plate 23 becomes larger (increase in the area). Particularly, if a portion between the nozzle communication channels 36 and individual communication openings 42 becomes larger (increase in the area), it is difficult to miniaturize the pressure chambers 31 and the pressure generation unit 14. In contrast, in the present embodiment, if the communication plate 23 is configured with a single member, there is no need to provide a space for adhering compared to a case of stacking the plurality of members and thus it is possible to miniaturize the communication plate 23 by suppressing the increase in the area thereof. In addition, it is possible to make the thickness thinner compared to a case of stacking the plurality of members by configuring the communication plate 23 with a single member. That is, in order to stack the plurality of members, a minimum thickness for strength required to perform the process or handling on the members is necessary, therefore, the thickness of the communication plate 23 becomes thicker when the plurality of members are stacked one another.

Meanwhile, the communication plate 23 of the present embodiment is provided with the flow channel which is not a turning point of the first liquid chamber 51, individual communication openings 42, and the nozzle communication channels 36, which belong to a passage section (penetrates in the thickness direction) and the second liquid chamber 52 which belongs to a non-passage section (does not penetrate in the thickness direction). However, the flow channel formed of these passage sections and non-passage section can be easily formed through the molding or machining process by using a single member from one side surface or both side surfaces. Therefore, the communication plate 23 is assumed to be a structure including no return flow channel, that is, the passage section or the flow channel having a concave shape and thus it is possible to be configured with a single member.

The compliance plates 25 are members that close areas of the communication plate 23 that are not covered by the nozzle plate 22, or in other words, openings on the lower surface sides of the common liquid chambers 32 (of the first liquid chambers 51 and the second liquid chambers 52). In this embodiment, two compliance plates 25 are joined, corresponding to the two common liquid chambers 32. The compliance plate 25 is a plate member configured by layering a low-rigidity, flexible sealing film 25*b* upon an anchoring plate 25*a* configured of a hard material such as a metal. A region of the anchoring plate 25*a* that faces the common liquid chamber 32 corresponds to an open section in which the anchoring plate 25*a* has been removed in the thickness direction thereof. Accordingly, the lower surface of the common liquid chamber 32 is sealed by the sealing film 25*b* and functions as a compliance portion that absorbs fluctuations in the pressure of the ink within the common liquid chamber 32. Note that one end in the second direction of each of the compliance plates 25 according to this embodiment is aligned with the outer form of the communication plate 23, whereas the other end is aligned with an edge of the opening regions 17*a* of the unit anchoring plate 17. A lid member of the present invention is configured to have the compliance plates 25 being provided with such a compliance portion and the unit anchoring plate 17 which is a wiper reception member.

That is, in the present embodiment, the common liquid chambers 32 include the first liquid chamber 51 penetrating the communication plate 23 and the second liquid chamber 52 not penetrating the compliance plates 25 of the thin section 40. As described above, by providing the second liquid chamber 52 on the side of compliance plates 25 of the thin section 40, it is possible to increase the capacity of the common liquid chambers 32 and thus to miniaturize the recording head 3. In addition, in order to secure the capacity of the common liquid chambers 32, it is necessary to widen the width of the first liquid chamber 51 to the opposite side of the thin section 40 and thus the recording head 3 becomes larger, therefore, the second liquid chamber 52 is not provided.

The common liquid chambers 32 are provided so as to widely open to the side of the compliance plates 25 by the second liquid chamber 52. The compliance function greatly affects the property of head and needs an area or volume, but by providing the common liquid chambers 32 by the second liquid chamber 52 so as to widely open to the side of the compliance plates 25, it is possible to provide the wide compliance portion which is a flexible portion of the compliance plates 25 without increasing the recording head 3.

Further, in the present embodiment, the ink conducting channel 45 is provided on the side opposite to the communication plate 23 of the ink conducting cavity 46 in the vertical direction. With such a configuration, the ink conducting cavity 46 can be formed vertically long and it is possible to suppress the recording head 3 from being increased in a direction of the surface of the nozzle surfaces 22*a*. Note that the common liquid chamber 32 may be a chamber to which one type of ink (liquid) is introduced or may be a chamber to which the inside is divided into several sections and various types of ink (liquid) are introduced. In addition, the division of the common liquid chambers 32 may be performed, for example, in the first direction (in a row (parallel) direction of the nozzles 27).

The head unit 16 that is configured in this manner is positioned and anchored to the unit anchoring plate 17 with the nozzle plate 22 exposed from the opening regions 17*a*. Specifically, the head unit 16 is anchored to the unit anchoring plate 17 by joining lower surfaces of the anchoring plates 25*a* of the compliance plates 25 to the upper surfaces of the unit anchoring plate 17 (the surfaces on the opposite side to the anchoring plate exposed-surface 17*b*). In this embodiment, each opening region 17*a* is formed so as to be slightly larger than the nozzle plate 22 so that the unit anchoring plate 17 and the nozzle plate 22 do not interfere with each other when the head unit 16 and the unit anchoring plate 17 are joined to each other even if the dimensions, joint position, and so on of the unit anchoring plate 17, the nozzle plate 22, or the like are skewed. In other words, a gap 54 is provided between the edges of the opening regions 17*a* in the unit anchoring plate 17 and the nozzle plate 22. Accordingly, a step is formed on both sides of the gap 54 (that is, on the side toward the unit anchoring plate 17 and the side toward the nozzle plate 22).

According to the invention, a configuration that suppresses ink from remaining on the nozzle surfaces 22*a* when the anchoring plate exposed-surface 17*b* and the nozzle surfaces 22*a* are wiped by the wiper member 12 is employed. Specifically, the configuration is such that the relationship expressed by the following Formula (1) is fulfilled when an angle of contact between the nozzle surfaces 22*a* of the nozzle plate 22 and the ink is taken as θn, an angle of contact between the anchoring plate exposed-surface 17*b* of the unit anchoring plate 17 and the ink is taken as θs, and an angle of contact between the wiper member 12 and the ink is taken as θw.

$$\theta n > \theta s > \theta w > 90° \quad (1)$$

For example, in the case where a water-based ink is used, a water-repellent film configured of a silane coupling agent (SCA) is formed on the nozzle surfaces 22*a*, a water-repellent film configured of polyphenylene sulfide (PPS) is formed on the anchoring plate exposed-surface 17*b*, and the wiper member 12 is formed from a fluorine resin. Alternatively, the wiper member 12 can be formed from a silicone resin and the surface thereof can then be coated with polystyrene (PS), polyethylene (PE), or the like. In addition to fluorine resins (PTFE, PFA, and FEP), silicone resin, polystyrene (PS), polyethylene (PE), and so on, materials of functional groups such as the saturated fluoroalkyl group (and particularly the trifluoromethyl group), the alkylsilyl group, the fluoroxyl group, the long-chain alkyl group, and so on are water-repellent materials that can be used for water-repellent films or the like. The surfaces of the nozzle surfaces 22*a*, the anchoring plate exposed-surface 17*b*, and the wiper member 12 are configured to fulfill the relationship expressed by Formula (1) by using these water-repellent materials in a suitable manner.

Figure 5:
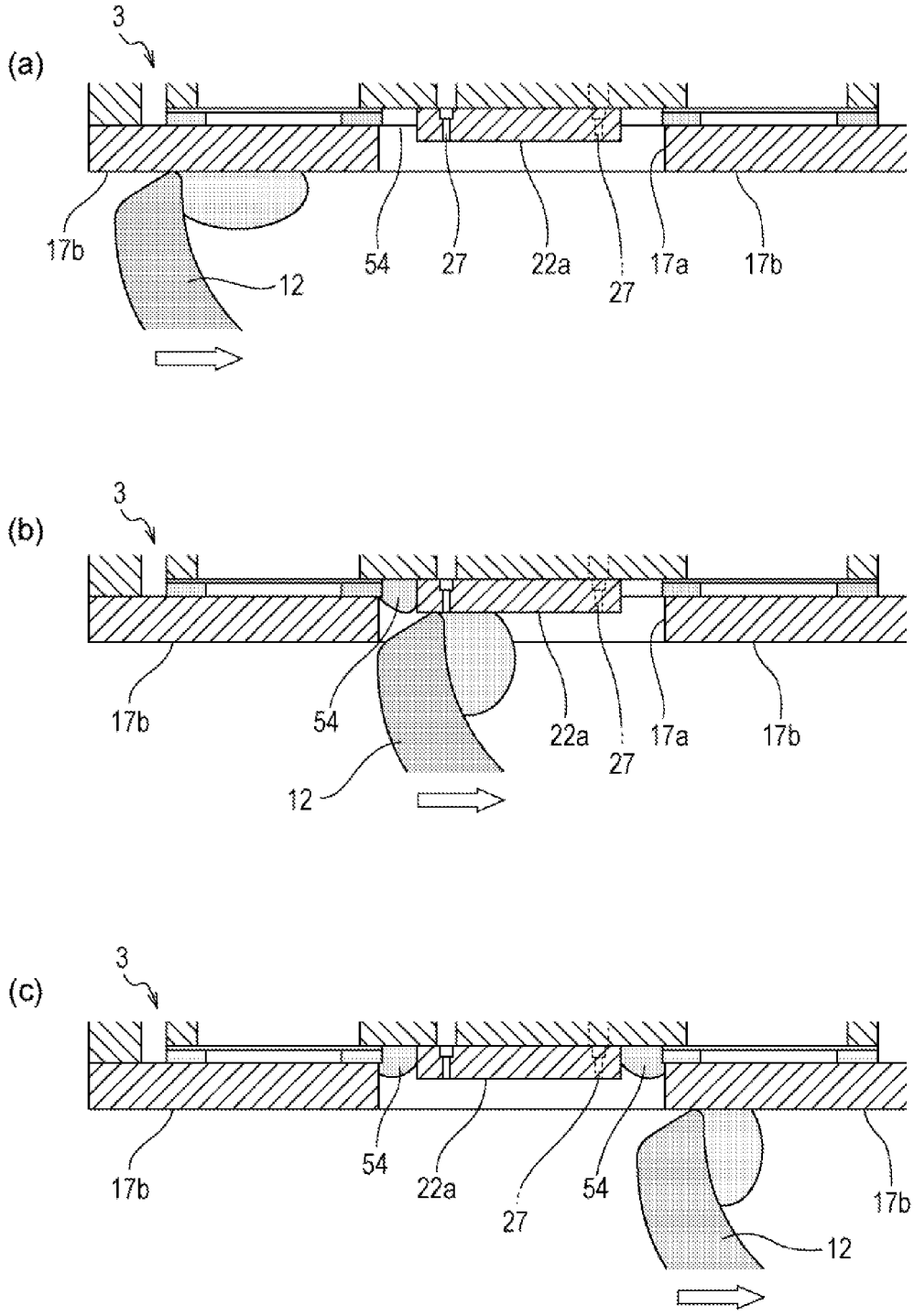
FIG. 5 is a schematic diagram illustrating a bottom surface of a recording head being wiped.

Next, wiping of the anchoring plate exposed-surface 17*b* and the nozzle surfaces 22*a* by the wiper member 12 will be described using FIG. 5. Note that in this embodiment, the wiper member 12 is moved relative to the direction orthogonal to the nozzle rows (that is, the second direction) by moving the carriage 4. Furthermore, FIG. 5 illustrates a state in which the wiper member 12 is moved from left to right along the second direction in order to wipe ink that has adhered to a left side end of the anchoring plate exposed-surface 17*b*.

First, the carriage 4 is moved toward the wiper member 12, and a leading end of the wiper member 12 makes contact with the bottom surface of the recording head 3 (the anchoring plate exposed-surface 17*b*). In this state, the wiper member 12 is moved (advanced) in a relative manner, toward the nozzle plate 22 (that is, toward a right-side end). As a result, as shown in FIG. 5(*a*), the ink that adheres to the anchoring plate exposed-surface 17*b* moves along with the wiper member 12 while being held on a front surface of the wiper member 12 (that is, the surface of the wiper member 12 located on the side in which the wiper member 12 advances). Furthermore, in this state, when the wiper member 12 reaches the gap 54 on one side (the stepped portion at the opening region 17*a*), some of the ink that is held on the front surface of the wiper member 12 remains in the gap 54 on the one side, as shown in FIG. 5(*b*). Here, according to the invention, the angle of contact between the wiper member 12 and the ink is set to be greater than 90° (θw>90°), which makes it possible to prevent the ink from adhering to a rear surface of the wiper member 12 (the surface of the wiper member 12 located on the opposite side to the side in which the wiper member 12 advances) immediately after the wiper member has passed the gap 54. As a result, the ink is suppressed from being pulled by the rear surface of the wiper member 12 and remaining on the nozzle surface 22*a*. After this, due to the elasticity of the wiper member 12, the wiper member 12 makes contact with the nozzle surface 22*a* while holding the ink on the front surface, and moves upon the nozzle surface 22*a*. Then, when the wiper member 12 reaches the gap 54 on the other side, some of the ink that is held on the front surface of the wiper member 12 remains in the gap 54 on the other side, as shown in FIG. 5(*c*). Here, the angle of contact between the wiper member 12 and the ink is set to be greater than 90° (θw>90°), which makes it possible to prevent the ink from adhering to the rear surface of the wiper member 12 immediately after the wiper member has passed the gap 54, in the same manner as with the one side. Furthermore, the angle of contact between the nozzle surface 22*a* and the ink is set to be greater than the angle of contact between the anchoring plate exposed-surface 17*b* and the ink (θn>θs), and thus the ink held on the wiper member 12 moves smoothly from the nozzle surface 22*a* toward the anchoring plate exposed-surface 17*b*. The wiper member 12 then sequentially wipes the anchoring plate exposed-surface 17*b* and nozzle surfaces 22*a* arranged in the head unit 16, but because the procedure is the same as described above, and descriptions thereof will be omitted. When the wiper member 12 reaches an endpoint on the bottom surface of the recording head 3 in the direction in which the wiper member 12 advances, the wiper member 12 separates from the anchoring plate exposed-surface 17*b* at this endpoint. At this time, the angle of contact between the anchoring plate exposed-surface 17*b* and the ink is set to be greater than the angle of contact between the wiper member 12 and the ink (θs>θw) and thus the ink held on the wiper member 12 moves smoothly toward the wiper member 12 without remaining on the anchoring plate exposed-surface 17*b*.

In this manner, the angle of contact between the nozzle surface 22*a* and the ink is set to be greater than 90° (θn>90°), or to rephrase, the nozzle surface 22*a* is liquid-repellent, and thus ink can be suppressed from remaining on the nozzle surface 22*a*. Furthermore, the angle of contact between the nozzle surface 22*a* and the ink is greater than the angles of contact between the ink and the anchoring plate exposed-surface 17*b*, the wiper member 12, and so on ($\theta n>\theta s>\theta w$), which makes it easier for the ink to move toward (or adhere to) the unit anchoring plate 17, the wiper member 12, and so on than the nozzle surface 22*a*; this in turn makes it possible to further suppress the ink from remaining on the nozzle surface 22*a*. Further still, the angle of contact between the wiper member 12 and the ink is set to be greater than 90° ($\theta w>90°$), which makes it possible to prevent the ink from adhering to the rear surface of the wiper member 12 (the surface of the wiper member 12 located on the opposite side to the side in which the wiper member 12 advances); this in turn makes it possible to further suppress the ink from remaining on the nozzle surface 22*a*.

When the wiper member 12 wipes the recording head 3, the wiper member 12 is allowed to firstly land (abut) on the anchoring plate exposed-surface 17*b* of the unit anchoring plate 17. That is, the wiper member 12 wipes the anchoring plate exposed-surface 17*b* and the nozzle surfaces 22*a* after landing on the unit anchoring plate 17. For this reason, there is no need to have an area on which the wiper member 12 directly lands on the nozzle surfaces 22*a* and the area of the nozzle surfaces 22*a* is reduced. Therefore, the nozzle plate 22 can be miniaturized. Incidentally, when the nozzle surfaces 22*a* which are opened by the nozzles 27 are wiped by the wiper member 12, there is a need to have an area on which the wiper member 12 lands on the nozzle surfaces 22*a* so as to wipe the nozzle surfaces 22*a* by the wiper member 12 by allowing the wiper member 12 to land (abut) on an end side of the nozzle surfaces 22*a*, therefore, high cost is caused due to an increase in the nozzle plate 22. Particularly, if a distance between the area where the wiper member 12 lands on the nozzle surfaces 22*a* and the nozzles 27 is short between each other, since unwiped ink is generated (remains) when the nozzle surfaces 22*a* are wiped by the wiper member 12, the distance between the area on which the wiper member 12 lands and the nozzles 27 needs to be separately disposed some distance from one another. Therefore, the nozzle plate 22 is increased (the nozzle surfaces 22*a*). Note that since the nozzles 27 are subjected to a high-precision process, equable thickness is required and high cost materials are used for the nozzle plate 22. In addition, an ink-repellent film or the like having liquid-repellency (ink-repellency) with respect to the ejecting liquid (ink) is formed on the nozzle surfaces 22*a* of the nozzle plate 22 and thus the high cost is caused due to the increase in the area.

In the present embodiment, since the wiper member 12 is allowed to land on the anchoring plate exposed-surface 17*b* of the unit anchoring plate 17 in advance without landing on the nozzle surfaces 22*a* firstly, it is possible to form the nozzle surfaces 22*a* with an area as small as possible to miniaturize the nozzle plate 22, thereby reducing the cost.

Further, in the present embodiment, the common liquid chambers 32 are configured to have the first liquid chamber 51 and the second liquid chamber 52, the width of the second liquid chamber 52 extends up to below the pressure chambers 31, and the compliance plates 25 closing the opening (the side of the nozzle plate 22) of the second liquid chamber 52 is provided. Accordingly, the flexible compliance portion can be disposed with a wide area, and the pressure fluctuation occurring when ink is supplied to the common liquid chambers 32 or the pressure fluctuation occurring when the ink droplet is ejected from the nozzles 27, or the like can be sufficiently absorbed in the compliance portion, thereby suppressing the generation of the crosstalk or the like.

In the present embodiment, since the compliance portion of the compliance plates 25 is covered by the unit anchoring plate 17, it is possible to suppress, for example, the destruction of the compliance portion and to wipe the anchoring plate exposed-surface 17*b* and the nozzle surfaces 22*a* by allowing the wiper member 12 to firstly land (firstly abut) on the area (the unit anchoring plate 17) in which the compliance portion is formed. That is, the common liquid chambers 32 common to the pressure chambers 31 which communicates with the nozzles 27 is sealed by the nozzle plate 22, the compliance plates 25, or the like, the compliance portion having the flexibility is provided in the sealed area, and thus the compliance portion can be disposed with the wide area. However, when the compliance portion is provided in the same surface side as the nozzle surfaces 22*a*, the wiper member 12 or the recording sheet (which is one type of the target for landing and the recording medium) abuts the compliance portion, which results in destruction of the compliance portion. In other words, the unit anchoring plate 17 serves for covering the compliance portion and suppressing the destruction caused by the recording sheet or the wiper member 12 abutting the compliance portion, and serves as an area on which the wiper member 12 is allowed to firstly land (firstly abut) when the nozzle surfaces 22*a* are wiped by the wiper member 12. In addition, since the wiper member 12 wipes the unit anchoring plate 17 covering the compliance portion, it is possible to suppress making the recording sheet dirty when ink attached on the unit anchoring plate 17 drops on the recording sheet with unexpected timing.

Incidentally, the invention is not limited to the above-described embodiment, and many variations based on the content of the appended aspects of the invention are possible.

Figure 6:
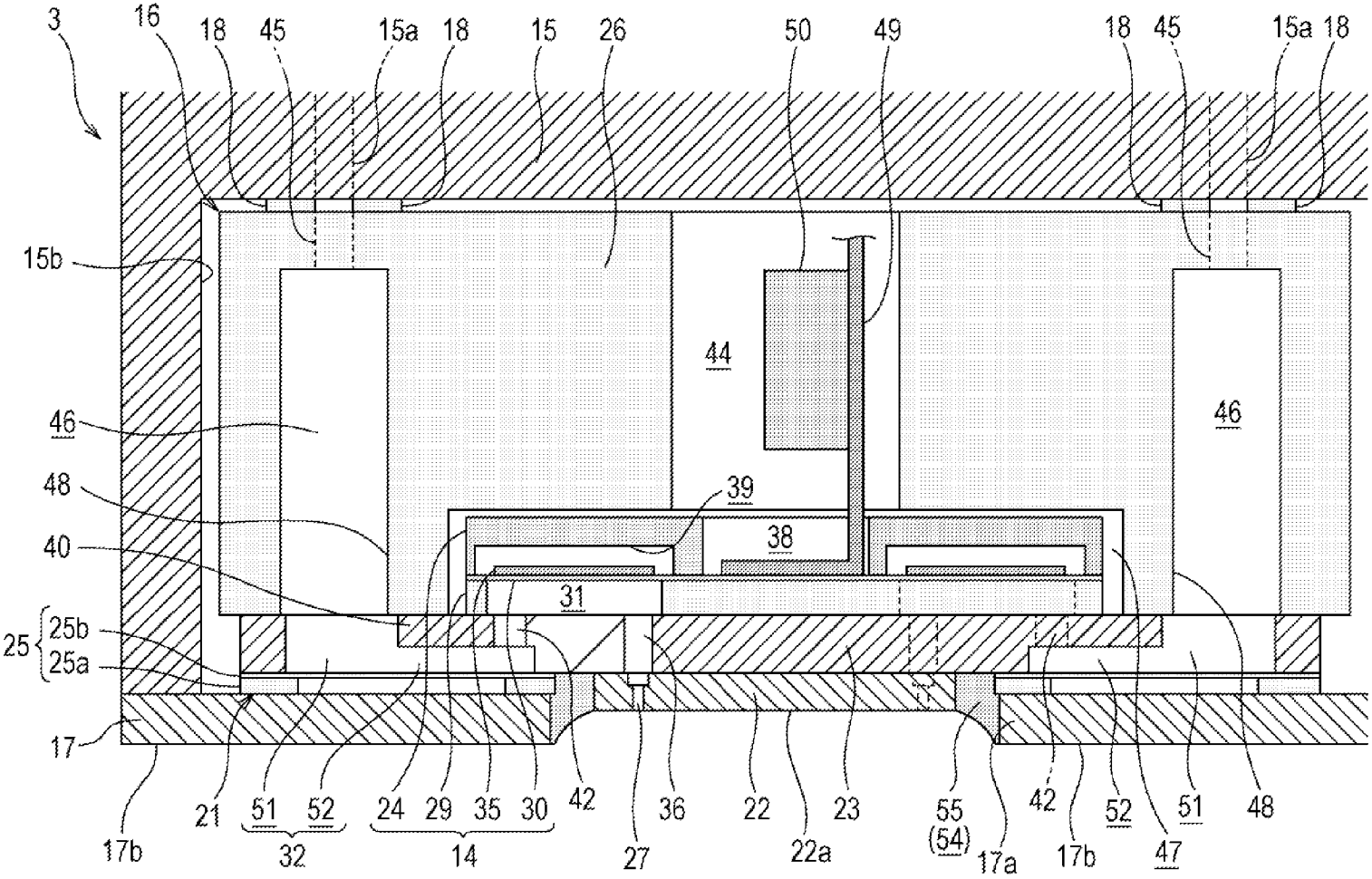
FIG. 6 is a cross-sectional view of a head unit according to a second embodiment.

For example, in a second embodiment shown in FIG. 6, the gap 54 provided between the edges of the opening regions 17*a* in the unit anchoring plate 17 and the nozzle plate 22 may be filled with a filler 55. This makes it possible to prevent the ink from remaining in the gap 54, and makes it possible to suppress the ink that does remain from adhering to the nozzle surface 22*a*. In this embodiment, the exposed surface of the filler 55 (a lower surface) is sloped upward from the anchoring plate exposed-surface 17*b* toward the nozzle surface 22*a* so as to smoothly connect the anchoring plate exposed-surface 17*b* to the nozzle surface 22*a* that is positioned higher (that is, closer to the communication plate 23) than the anchoring plate exposed-surface 17*b*. Through this, the wiper member 12 can move smoothly when moving from the anchoring plate exposed-surface 17*b* to the nozzle surface 22*a*, which makes it possible for the wiper member 12 to hold the ink with more certainty. Meanwhile, a water-repellent material, selected as appropriate so that the relationship expressed by the following Formula (2) is fulfilled when an angle of contact between the filler 55 and the ink is taken as $\theta f$, is used for the filler 55 according to this embodiment.

$$\theta n>\theta f>\theta s \tag{2}$$

Doing so makes it easier for the ink on the nozzle surface 22*a* to move toward the anchoring plate exposed-surface 17*b* along the surface of the filler 55, which makes it possible to further suppress the ink from remaining on the nozzle surface 22*a*. Note that because other configurations are identical to those described in the aforementioned embodiment, descriptions thereof will be omitted here.

Furthermore, although a so-called flexurally-vibrating piezoelectric element 35 is described as an example of the pressure generation unit in the aforementioned embodiments, the pressure generation unit is not limited thereto, and, for example, a so-called longitudinally-vibrating piezoelectric element can be employed as well. Pressure generation units such as a heating element that produces pressure fluctuations by generating heat in order to produce bubbles within the ink, a static electricity actuator that produces pressure fluctuations by using static electricity to cause partition walls of a pressure chamber to deform, and so on can also be applied as the pressure generation unit in the invention.

In the above described embodiment, two rows in which the pressure chambers 31 are provided parallel with the pressure chamber formation plate 29 are provided, but there is no limitation thereto, for example, the pressure chambers 31 may be provided on the pressure chamber formation plate 29 in a matrix shape. Even in this case, the communication plate 23 and the nozzle plate 22 are joined to pressure chamber formation plate 29, and the unit anchoring plate 17 different from the nozzle plate 22 may be provided on the communication plate 23. Meanwhile, the position of the pressure chambers 31 provided on the pressure chamber formation plate 29 may be the same or a different position in a direction of the nozzle row (a direction in which the pressure chambers 31 are provided in parallel with each other in a first row) even if the nozzle rows are more than two.

As described above, an ink jet type-recording head 3 (the head unit 16) which is a type of the liquid ejecting head is exemplified, but the present invention can be applied to another liquid ejecting head employing a configuration in which liquid is introduced from the upper opening of the first liquid chamber and supplied to the pressure chamber by passing the downside of the thin section which is the ceiling surface of the second liquid chamber through the individual communication openings. For example, the present invention can be applied to a color material ejecting head used in manufacturing of a color filter such as a liquid crystal display, an electrode material ejecting head used in forming an electrode such as an organic electro Luminescence (EL) display and a field emission display (FED), and a bio-organic material ejecting head used in manufacturing bio tips.

REFERENCE SIGNS LIST

1 printer
3 recording head
12 wiper member
14 pressure generation unit
15 case
16 head unit
17 unit anchoring plate
17*a* opening region
17*b* anchoring plate exposed-surface
21 flow channel unit
22 nozzle plate
22*a* nozzle surface
23 communication plate
25 compliance plate
26 unit case
27 nozzle
29 pressure chamber formation plate
31 pressure chamber
32 common liquid chamber
35 piezoelectric element
40 thin section
42 individual communication opening
51 first liquid chamber
52 second liquid chamber
54 gap
55 filler

The invention claimed is:

1. A liquid ejecting apparatus comprising:

a liquid ejecting head unit capable of ejecting a liquid from a nozzle provided in a nozzle surface of a nozzle formation member;

an anchoring plate that is anchored to the liquid ejecting head unit and that is provided with an opening region that exposes the nozzle surface; and a wiper member that wipes the nozzle surface and an anchoring plate exposed-surface located on an opposite side of the anchoring plate to the liquid ejecting head unit, wherein when an angle of contact between the nozzle surface and the liquid is taken as $\theta n$, an angle of contact between the anchoring plate exposed-surface and the liquid is taken as $\theta s$, and an angle of contact between the wiper member and the liquid is taken as $\theta w$, the relationship $\theta n>\theta s>\theta w>90°$ is fulfilled.

2. The liquid ejecting apparatus according to claim 1, wherein a gap is provided between an edge of the opening region of the anchoring plate and the nozzle formation member; and the gap is filled with a filler.

3. The liquid ejecting apparatus according to claim 2, wherein when an angle of contact between the filler and the liquid is taken as $\theta f$, the relationship $\theta n>\theta f>\theta s$ is fulfilled.

4. The liquid ejecting apparatus according to claim 1, wherein the wiper member is formed of an elastic member.

* * * * *